United States Patent [19]

Toyomura et al.

[11] 4,022,432

[45] May 10, 1977

[54] POWER TRANSMISSION IN DOUBLE-DRUM WINCH

[75] Inventors: Akihiro Toyomura; Yutaka Sugimoto, both of Hirakata; Ryoji Shiota, Katano, all of Japan

[73] Assignee: Kabushiki Kaisha Komatsu Seisakusho, Tokyo, Japan

[22] Filed: July 7, 1975

[21] Appl. No.: 593,516

[52] U.S. Cl. ..... 254/185 B; 74/740

[51] Int. Cl.² ..... B66D 1/26

[58] Field of Search ..... 254/185 B, 185 R; 212/55, 39 A; 74/740, 768, 325

[56] References Cited

UNITED STATES PATENTS

| | | | |
|---|---|---|---|
| 2,010,280 | 8/1935 | Thiman | 254/185 R |
| 2,445,116 | 7/1948 | Huston | 254/185 B |
| 2,605,650 | 8/1952 | Winther et al. | 74/740 |
| 2,857,137 | 10/1958 | Fillion | 254/185 R |
| 3,429,202 | 2/1969 | Galicher | 74/740 |
| 3,487,724 | 1/1970 | McIntyre et al. | 74/740 |
| 3,572,167 | 3/1971 | Bosko et al. | 74/740 |
| 3,578,787 | 5/1971 | Brickett et al. | 254/185 R |
| 3,733,812 | 5/1973 | Lawrence | 254/185 R |
| 3,774,474 | 11/1973 | Recker et al. | 74/740 |

*Primary Examiner*—L. J. Paperner
*Assistant Examiner*—Kenneth Noland
*Attorney, Agent, or Firm*—Armstrong, Nikaido & Marmelstein

[57] ABSTRACT

Double-drum winch has a power source, a transmission comprised of planetary gear systems alternately actuated by hydraulically actuated clutches for changing the direction of rotation of the output shaft thereof and speed changing reduction gear sets selectively actuated by dog clutches for changing the speed of the output shaft, a drum shaft driven by the transmission, and a hook drum and a boom drum independently rotatable on the drum shaft relative to the drum shaft. The hook drum is provided with hydraulically actuated hook clutch for rotation of the hook drum together with the drum shaft and hydraulically actuated hook brake for arresting the rotation of the hook drum, while the boom drum is provided with hydraulically actuated boom clutch and boom brake of the similar performance. A first hydraulic control system actuated by a first manually operable means controls the clutches of the planetary gear systems and the hook clutch and the hook brake, while a second hydraulic control system actuated by a second manually operable means controls the clutches of the planetary gear systems and the boom clutch and the boom brake thereby permitting the hook drum and the boom drum controlling the hook and the boom, respectively, to be independently actuated in any of the modes of operations by the selective actuation of the first and the second manually operable means, while the dog clutches for the speed changing reduction gear sets are selectively actuated by a third manually operable means, so that only three manually operable means can control the winch for any of the modes of operations at different speeds.

3 Claims, 2 Drawing Figures

POWER TRANSMISSION IN DOUBLE-DRUM WINCH

BACKGROUND OF THE INVENTION

1. Field of the Invention:

This invention relates to a winch for use in a side crane of a construction machinery, and more particularly to a power transmission in a double-drum winch in which the respective drums are independently operated for the desired operation of the hook and the boom.

2. Description of the Prior Art:

In a prior art winch of the type described above heretofore known, since the two drums for the operation of the hook and the boom, respectively, cannot be independently operated from each other, an operation such as to move the hook upwardly or downwardly by one of the drums while the boom is moved upwardly or downwardly by the other drum can not be carried out. Thus, the range of modes of operation is necessarily limited. Further, the prior art winch is provided with a plurality of operating levers for operating for example, the hook brake, the boom brake, the hook gear, the boom gear, the transmission and the clutches of the winch, thereby tending to cause erroneous operation of the winch and early fatigue of the operator. Thus, an operator skilled in the operation of the winch is required.

In view of the above described disadvantages of the prior art double-drum winch, this invention contemplates to eliminate those disadvantages.

SUMMARY OF THE INVENTION

An object of this invention is to provide a novel and useful power transmission in a double-drum winch wherein the respective drums are independently operated by a few number of manually operable controls means or levers so that the range of modes of operation of the winch is extended while the operation of the winch is greatly simplified without requiring an operator skilled in operation thereby permitting erroneous operation to be positively avoided.

The above object is achieved in accordance with the characteristic feature of this invention by providing a double-drum winch having a power source, a transmission with its input shaft connected to the power source and having a forward driving connection clutch, a reverse driving connection clutch and speed changing clutch means so that an output shaft of the transmission can be selectively driven in either of the forward and the reverse direction at selected one of various speeds, a drum shaft operatively connected to the output shaft of the transmission so as to be driven thereby, a hook-drum rotatably supported on the drum shaft and having a hook wire wound therearound for actutating a hook concentrated thereto by the rotation of the hook drum, a boom drum rotatably supported on the drum shaft and having a boom drum wound therearound for actuating a boom connected thereto by the rotation of the boom drum, the winch being characterized by a forward driving planetary gear system arranged in the transmission around the input shaft thereof and engageable with the forward driving connection clutch so as to drive the output shaft in the forward direction when engaged, a reverse driving planetary gear system arranged in the transmission around the input shaft and engageable with the reverse driving connection clutch so as to drive the output shaft in the reverse direction, a plurality of reduction gears sets arranged in the transmisson and engageable with the speed changing clutch means, a hydraulically operated hook clutch engageable with the hook drum so as to drive the same together with the drum shaft, a hydraulically operated hook brake engageable with the hook drum so as to arrest the rotation of the hook drum, a hydraulically operated boom clutch engageable with the boom clutch so as to drive the same together with the drum shaft, a hydraulically operable boom brake engageable with the boom drum so as to arrest the rotation of the boom drum, a first hydraulic control system having a hook clutch actuating valve connected to the hook clutch; a hook brake actuating valve connected to the hook brake, a forward driving connection clutch actuating valve connected to the forward driving connecton clutch actuating and a reverse driving connection clutch actuating valve connected to the reverse driving connection clutch, a first manually operable means operably connected to the hook clutch actuating valve, the hook brake actuating valve, the forward driving connection clutch actuating valve and the reverse driving connection clutch actuating valve so as to selectively position the respective valves connected thereto upon selected manipulation of the first manually operable means thereby effecting selected mode of operation of the hook, a second hydraulic control system having a boom clutch actuating valve connected to the boom clutch the forward driving connection clutch actuating valve, the reverse driving connection clutch actuating valve and a boom brake actuating valve connected to the boom brake, a second manually operable means operably connected to the boom clutch actuating valve, the forward driving connection clutch actuating valve, the reverse driving connection clutch actuating valve and the boom brake actuating valve so as to selectively position the respective valves connected thereto upon selected manipulation of the second manually operable means thereby effecting selected mode of operation of the boom and a third manually operable means operably connected to the speed changing clutch means so as to selectively change the speed of the output of the transmission by the selected operation of the third manually operable means, thereby permitting the hook and the boom to be operated at a selected speed in any of the various modes of operations of the winch by selected operation of any one or more of the first to three manually operable means.

The above and other objects, features and advantages of this invention will become fully apparent from the following description taken in conjunction with the accompanying drawings, in which like reference numerals and characters designate corresponding parts and components.

DETAILED DESCRIPTION OF THE PREFERRED EMBODIMENT

Figure 1:
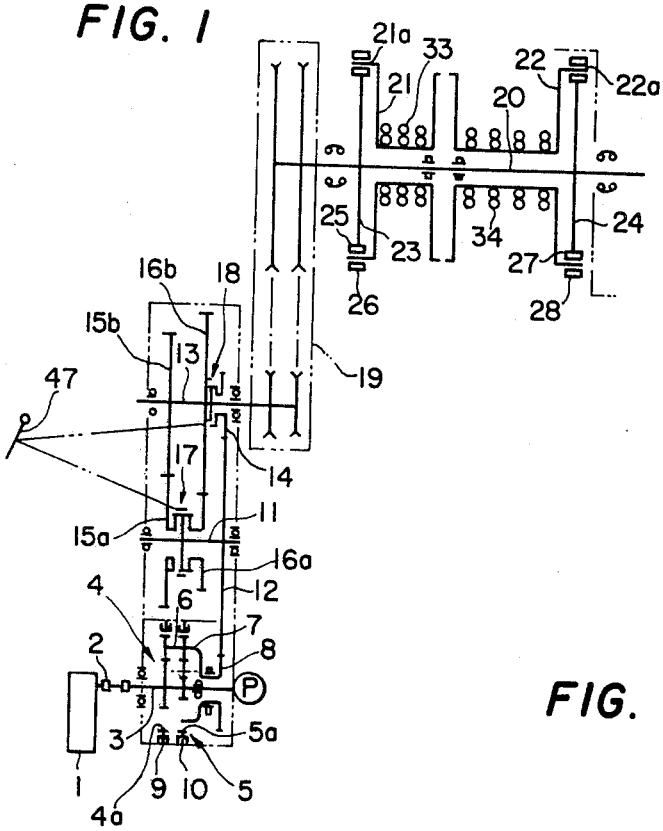
FIG. 1 is a schematic sectional view of the embodiment of the double-drum winch according to this invention.

Referring to FIG. 1, a power source 1 such as an engine mounted on a construction vehicle, for example, is connected via a universal coupling 2 to the driving or input shaft 3 of the transmission shown encircled by two dot chain line. A forward driving planetary gear system 4 and a reverse driving planetary gear system 5 are arranged around the driving shaft 3.

The forward driving planetary gear system 4 comprises a sun gear secured to the driving shaft 3, planetary pinion gears rotatably supported on a rotatable carrier 6 and meshing with the sun gear and a rotatable ring gear 4*a* meshing with the planetary pinion gears. The ring gear 4*a* cooperates with a hydraulically actutated forward driving connection clutch 9 provided in the transmission so that, when the clutch 9 is engaged, the ring gear 4*a* is arrested its rotation thereby rotating the carrier 6 in the forward direction by the rotation of the driving shaft 3.

In the similar manner, the reverse driving planetary gear system 5 comprises a sun gear secured to the driving shaft 3, idle pinion gears rotatably supported on a carrier 7 which is integral with a driving gear 8 and meshing with the sun gear, planetary pinion gears also rotatably supported on the carrier 7 and meshing with the idle pinion gears and a rotatable ring gear 5*a* meshing with the planetary pinion gears. The ring gear 5*a* cooperates with a hydraulically actuated reverse driving connection clutch 10 provided in the transmission so that, when the clutch 10 is engaged, the ring gear 5*a* is arrested its rotation thereby rotating the carrier 7 together with the driving gear 8 in the reverse direction by the rotation of the driving shaft 3 by virtue of the provision of the idle pinion gears.

The carrier 6 is connected to the carrier 7 so that the driving gear 8 is rotated in the forward direction by the carrier 6 via the carrier 7 when the clutch 9 is engaged while the clutch 10 is disengaged.

The driving gear 8 meshes with a large gear 12 secured to a first intermediate shaft 11 and the large gear 12 in turn meshes with a dog gear 14 rotatably supported on a second intermediate shaft 13. A dog clutch 18 cooperates with the dog gear 14 and the second intermediate shaft 13 so that, when the dog clutch 18 is engaged, the shaft 13 is secured to the dog gear 14 and rotated therewith by the rotation of the large gear 12.

A gear 15*a* is rotatably supported on the first intermediate shaft 11 which meshes with a gear 15*b* of the size larger than the gear 15*a* secured to the second intermediate shaft 13, the gears 15*a*, 15*b* forming the first reduction gear set. In the similar way, a gear 16*a* having the size different from the gear 15*a* and rotatably supported on the shaft 11 meshes with a gear 16*b* of the size larger than the gear 16*a* secured to the shaft 13, the gears 16*a*, 16*b* forming a second reduction gear set having the reduction ratio different from that of the first reduction gear set.

A dog clutch 17 cooperates with the gear 15*a* and the gear 16*a* so that either one of the gear 15*a* and the gear 16*a* is secured to the shaft 11 or both of the gears 15*a*, 16*a* are free from the shaft 11 by the selective operation of the dog clutch 17. Thus, when the gear 15*a* is secured to the shaft 11, the shaft 13 is rotated through the first reduction gear set by the rotation of the shaft 11 at a speed determined by the reduction ratio of the first reduction gear set while, when the gear 16*a*, is secured to the shaft 11, the shaft 13 is rotated at a speed different from what obtained through the first reduction gear set. When the dog clutch 18 is engaged to secure the gear 14 to the shaft 13 and both the gears 15*a*, 16*a* are disengaged from the shaft 11 by the selective operation of the dog clutch 17, the large gear 12 directly drives the gear 14 and, hence, the shaft 13 at a further different speed than those obtained through the first and the second reduction gear set. It is apparent that the direction of rotation of the shaft 11 and, hence, the shaft 13 is reversed whether the forward driving connection clutch 9 or the reverse driving connection clutch 10 is engaged.

The shaft 13 is connected to a drum shaft 20 through a pulley-chain driving system 19 so as to rotate the drum shaft 20.

A hook drum 22 having a flange 22*a* and a boom drum 21 having a flange 21*a* are independently rotatably mounted on the drum shaft 20.

In the conventional manner, a hook wire 34 is wound around the drum 22 so as to control the hook (not shown) of the winch by the rotation of the drum 22 while a boom wire 33 is wound around the drum 21 so as to control the boom (not shown) of the winch.

A clutch wheel 24 is secured to the drum shaft 20 and a hydraulically actuated hook clutch 27 cooperates with the flange 22*a* of the hook drum 22 and the clutch wheel 24 so that, when the Clutch 27 is engaged, the hook drum 22 is rotated by the drum shaft 20. A hydraulically actuated hook brake 28 is arranged around the flange 22*a* so that, when the brake 28 is applied or engaged, the hook drum 22 is arrested its rotation.

In the similar manner, a clutch wheel 23 is secured to the drum shaft 20 and a hydraulically actuated boom clutch 25 cooperates with the flange 21*a* of the boom drum 21 and the clutch wheel 23 so that, when the clutch 25 is engaged, the boom drum 21 is rotated by the drum shaft 20. A hydraulically actuated boom brake 26 is arranged ground the flange 21*a* so that, when the brake 26 is applied or engaged, the boom drum 21 is arrested its rotation.

Figure 2:
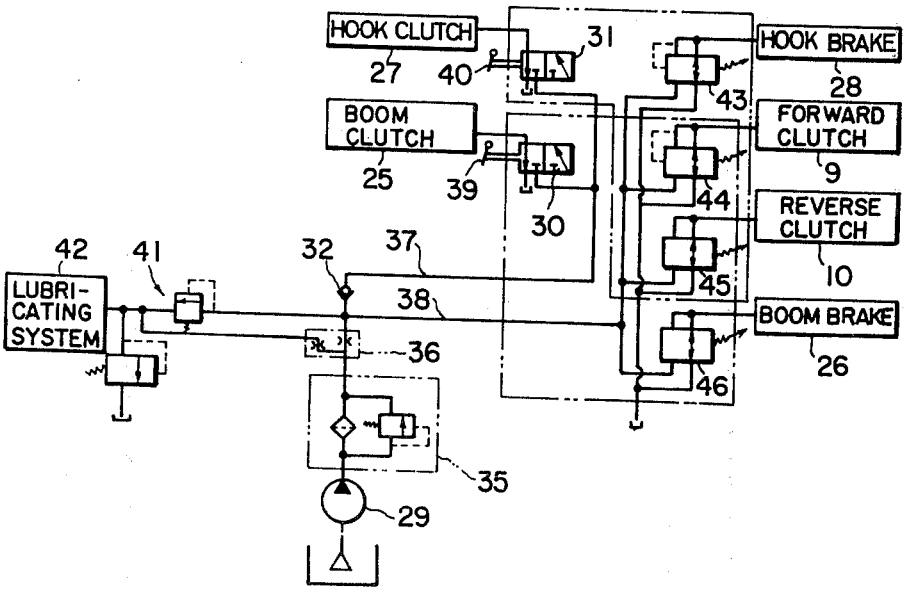
FIG. 2 is a hydraulic circuit view for use with the embodiment shown in FIG. 1.

FIG. 2 shows the hydraulic control circuit used in the winch of this invention as described above.

The pressurized working fluid supplied from the sump through the hydraulic pump 29 is lead to a first fluid circulating passage 37 through a filter 35, a flow divider 36 and a check valve 32 and to a second fluid circulating passage 38 through the filter 35 and the flow divider 36. The first fluid passage 37 supplies the working fluid to a hook clutch actuating valve 31 leading to the hook clutch 27 and to a boom clutch actuating valve 30 leading to the boom clutch 25.

The second fluid passage 38 supplies the pressurized working fluid to the lubricating system 42 of the winch through a pressure regulating valve 4 on one hand and to a hook brake actuating valve 43 connected to the hook brake 28, a forward driving connection clutch actuating valve 44 connected to the forward driving connection clutch 9, a reverse driving connection clutch actuating valve 45 connected to the reverse driving connection clutch 10 and a boom brake actuating valve 46 connected to the boom brake 26 on the other hand.

A first manually operable means 40 such as a control lever is mechanically coupled with the hook clutch actuating valve 31 as well as with the above described control valves 43, 44 and 45 through a linkage mechanism (not shown) so that the valves 31, 43, 44 and 45 are actuated selectively and individually by the selected operation of the first manually operable means 40, whereby the valves 31, 43, 44 and 45 constitute the first hydraulic control system for the hook as described later.

In the similar manner, a second manually operable means 39 such as a control lever is mechanically coupled with the boom clutch actuating valve 30 as well as with the control valves 44, 45 and 46 through another linkage mechanism (not shown) so that the valves 30, 44, 45 and 46 are actuated selectively and individually by the selected operation of the second manually operable means 39, whereby the valves 30, 44, 45 and 46 constitute a second hydraulic control system for the boom as described later.

As described above, the hook clutch 27, the hook brake 28, the boom clutch 25, the boom brake 26, the forward driving connection clutch 9 and the reverse driving connection clutch 10 are individually controlled by only the first and the second manually operable means 40 and 39.

A third manually operable means 47 such as a control lever is coupled with the dog clutches 17 and 18 so that the shaft 13 is driven at any one of the three different speeds by the selective engagement of the gear 15a or 16a with the shaft 11 or the direct driving of the shaft 13 by the dog gear 14 and the large gear 12 by the selected operation of the third manually operable means 47.

The reference character P designates a dumping pump for dumping the vibration of the gears in the transmission.

The clutches are engaged when pressurized fluid is applied and disengaged by the spring force while the brakes are engaged by the spring force and disengaged by the application of pressurized fluid thereto as shown in Table 1 below.

Table 1

| Position of Brakes and Clutches Set by Spring and Fluid Pressure | Engage | Disengage |
|---|---|---|
| Hook Brake 28 | Spring | Fluid Pressure |
| Boom Brake 26 | Spring | Fluid Pressure |
| Forward Driving Connection Clutch 9 | Fluid Pressure | Spring |
| Reverse Driving Connection Clutch 10 | Fluid Pressure | Spring |
| Hook Clutch 27 | Fluid Pressure | Spring |
| Boom Clutch 25 | Fluid Pressure | Spring |

Table 2 shows the positions of the brakes and clutches in various modes of operations of the winch as effected by the selected operation of the first and the second manually operable means 40 and 39.

Table 2

| Positions of Brakes and Clutches in Various Modes of Operations | | | | | | | | |
|---|---|---|---|---|---|---|---|---|
| | Operation | | Clutches | | | | Brakes | |
| | Hook | Boom | Forward 9 | Reverse 10 | Hook 27 | Boom 25 | Hook 28 | Boom 26 |
| A | Up | Up | Engage | Dis-engage | Engage | Engage | Dis-engage | Dis-engage |
| B | Down | Down | Dis-engage | Engage | Engage | Engage | Dis-engage | Dis-engage |
| C | Up | Free Fall | Engage | Dis-engage | Engage | Dis-engage | Dis-engage | Dis-engage |
| D | Free Fall | Up | Engage | Dis-engage | Dis-engage | Engage | Dis-engage | Dis-engage |
| E | Stop | Up | Engage | Dis-engage | Dis-engage | Engage | Engage | Dis-engage |
| F | Stop | Down | Dis-engage | Engage | Dis-engage | Engage | Engage | Dis-engage |
| G | Up | Stop | Engage | Dis-engage | Engage | Dis-engage | Dis-engage | Engage |
| H | Down | Stop | Dis-engage | Engage | Engage | Dis-engage | Dis-engage | Engage |
| I | Stop | Stop | Dis-engage | Dis-engage | Dis-engage | Dis-engage | Engage | Engage |

For example, when the mode A of the operation is to be carried out, the first and the second manually operable means 40 and 39 are so operated that the forward driving connection clutch 9 is engaged through the valve 44 so as to drive the driving gear 8 in the forward direction and the hook clutch 27 and boom clutch 25 are engaged through the valves 31 and 30, respectively, so as to rotate the hook drum 22 and the boom 21 in the forward direction for moving the hook and the boom upwardly while the brakes 28, 26 and the reverse driving connection clutch 10 are disengaged. The speed can be changed by manipulating the manually operable means 47.

The mode B of the operation can be carried out by engaging the reverse driving connection clutch 10 instead of the forward driving connection clutch 9 so that the driving gear 8 is rotated in the reverse direction thereby lowering the hook and the boom.

The other modes of operations can be carried out in accordance with the setting of the positions of the clutches and brakes as shown in Table 2.

As described above, this invention provides a useful power transmission of a double-drum winch which permits all the modes of operations of the hook and the boom to be easily carried out by only three manually operable means at different speeds.

Since the planetary gear systems are employed in refersing the rotation of the driving gear, the constructions is made simple and smooth switching operation is insured.

We claim:

1. Double-drum winch having a power source, a transmission with its input shaft connected to said power source and having a forward driving connection clutch, a reverse driving connection clutch and speed changing clutch means so that an output shaft of said transmission can be selectively driven in either of the forward and the reverse direction at selected one of various speeds, a drum shaft operatively connected to the output shaft of said transmission so as to be driven thereby, a hook-drum rotatably supported on said drum shaft and having a hook wire wound therearound for actuating a hook connected thereto by the rotation of said hook drum, a boom drum rotatably supported on said drum shaft and having a boom drum wound therearound for actuating a boom connected thereto by the rotation of said boom drum, wherein the improvement comprises a forward driving planetary gear system arranged in said transmission around said input shaft thereof and engageable with said forward driving connection clutch so as to drive said output shaft in the forward direction when engaged, a reverse driving planetary gear system arranged in said transmission around said input shaft and engageable with said reverse driving connection clutch so as to drive said output shaft in the reverse direction, a plurality of reduction gear sets arranged in said transmission and engageable with said speed changing clutch means, a hydraulically operated hook clutch engageable with said hook drum so as to drive the same together with said drum shaft, a hydraulically operated hook brake engageable with said hook drum so as to arrest the rotation of said hook drum, a hydraulically operated boom clutch engageble with said boom clutch so as to drive the same together with said drum shaft, a hydraulically operable boom brake engageable with said boom drum so as to arrest the rotation of said boom drum, a first hydraulic control system having a hook clutch actuating valve connected to said hook clutch, a hook brake actuating valve connected to said hook brake, a forward driving connection clutch actuating valve connected to said forward driving connection clutch and a reverse driving connection clutch actuating valve connected to said reverse driving connection clutch, a first manually operable means operably connected to said hook clutch actuating valve, said hook brake actuating valve, said forward driving connection clutch actuating valve and said reverse driving connection clutch actuating valve so as to selectively position the respective valves connected thereto upon selected manipulation of said first manually operable means thereby effecting selected operation of said hook, a second hydraulic control system having a boom clutch actuating valve connected to said boom clutch, said forward driving connection clutch actuating valve, said reverse driving connection clutch actuating valve and a boom brake actuating valve connected to said boom brake, a second manually operable means operably connected to said boom clutch actuating valve, said forward driving connection clutch actuating valve, said reverse driving connection clutch actuating valve and said boom brake actuating valve so as to selectively position the respective valves connected thereto upon selected manipulation of said second manually operable means thereby effecting selected operation of said boom and a third manually operable means operably connected to said speed changing clutch means so as to selectively change the speed of the output of said transmission by the selected operation of said third manually operable means, thereby permitting said hook and said boom to be operated at a selected speed in any of the various modes of operations of said winch by selected operation of any one or more of said first to three manually operable means.

2. Double-drum winch according to claim 1, wherein said forward driving planetary gear system comprises a sun gear secured to said input shaft of said transmission, planetary pinion gears rotatably mounted on a rotatable carrier and meshing with said sun gear and a ring gear rotatably arranged about said input shaft and meshing with said planetary pinion gears, said ring gear being engageable with said forward driving connection clutch so that said carrier is driven when said forward driving connection clutch is engaged thereby rotating said output shaft in the forward direction, said reverse driving planetary gear system comprising a sun gear secured to said input shaft, idle pinion gears rotatably mounted on a rotatable carrier mounted on said input shaft and recured to said carrier of said forward driving planetary gear system and meshing with said sun gear, planetary pinion gears rotatably mounted on said carrier and meshing with said idel pinion gears, respectively, and a ring gear rotatably arranged about said input shaft and meshing with said planetary pinion gears, said ring gear being engageable with said reverse driving connection clutch so that said carrier is driven when said reverse driving connection clutch is engaged thereby rotating said output shaft in the reverse direction, said speed changing clutch means comprising a first and a second dog clutch, said transmission comprising a first, a second and a third reduction gear set of different reduction ratios, said first dog clutch being selectively engageable with said first and said second reduction gear set and said second dog clutch being engageable with said third reduction gear set so as to drive said output shaft at one of two different speeds by selectively engaging said first dog clutch to either one of said first and said second reduction gear set when said second dog clutch is disengaged while said output shaft is driven at a further different speed by the engagement of said second dog clutch with said third reduction gear set when said first dog clutch is disengaged.

3. Double-drum winch according to claim 1 further comprising pulley-chain driving mechanism interposed between said output shaft of said transmission and said drum shaft.

* * * * *